United States Patent [19]

Panzer

[11] 4,074,978

[45] Feb. 21, 1978

[54] COMBINATION OF ASPHALTENES WITH FLOW IMPROVER POLYMERS TO IMPROVE THE FLOW PROPERTIES OF HIGH BOILING FUEL OILS

[75] Inventor: Jerome Panzer, Roselle Park, N.J.

[73] Assignee: Exxon Research & Engineering Co., Linden, N.J.

[21] Appl. No.: 405,919

[22] Filed: Oct. 12, 1973

[51] Int. Cl.[2] ..... C10L 1/18

[52] U.S. Cl. ..... 44/62; 44/66; 44/70

[58] Field of Search ..... 44/66, 62, 70

[56] References Cited

U.S. PATENT DOCUMENTS

| | | | |
|---|---|---|---|
| 2,664,388 | 12/1953 | Winterhalter | 208/33 |
| 2,938,775 | 5/1960 | Siegel | 44/62 |
| 3,369,992 | 2/1968 | Henke et al. | 208/14 |
| 3,449,251 | 6/1969 | Tunkel et al. | 44/62 |
| 3,660,057 | 5/1972 | Ilnyckyj | 44/80 |
| 3,792,984 | 2/1974 | Cole et al. | 44/62 |
| 3,853,497 | 12/1974 | Miller et al. | 44/62 |
| 3,862,825 | 1/1975 | Sweeney | 44/62 |

FOREIGN PATENT DOCUMENTS

| | | | |
|---|---|---|---|
| 1,154,966 | 6/1969 | United Kingdom | 44/62 |

OTHER PUBLICATIONS

Kalichevsky et al., "Petroleum Refining with Chemicals," p. 524, 1956.

*Primary Examiner*—Floyd D. Higel
*Assistant Examiner*—Mrs. Y. Harris-Smith
*Attorney, Agent, or Firm*—Frank T. Johmann; Eugene Zagarella

[57] ABSTRACT

Certain high boiling (e.g. above 600° F) fuel oils, such as atmospheric residua fuel oils, and vacuum distillate fuels, e.g., flash distillate oils, vacuum bottoms, and various fuel blends containing said oils, which are deficient in an asphaltene component can be made more responsive to polymeric flow improvers by treating them with certain asphaltene materials. These asphaltene materials may be added either directly to the oil or first combined with the flow improver and the combination added to the oil. The polymeric flow improvers are polymers having long linear side chains. The asphaltene materials added to the oil, will generally have a heptane precipitatable asphaltene content of 5 to 100% by weight and can either be asphaltenes per se, or an oil fraction high in asphaltenes.

7 Claims, No Drawings

COMBINATION OF ASPHALTENES WITH FLOW IMPROVER POLYMERS TO IMPROVE THE FLOW PROPERTIES OF HIGH BOILING FUEL OILS

BACKGROUND OF THE INVENTION

The invention relates to improvements in the flow properties of high boiling fuel oils, and more particularly relates to fuels comprising residuum or vacuum oils having additives incorporated therein to improve their flow properties.

It is well known that petroleum oils often contain wax which will separate out if the oil is cooled down to below a certain temperature. As the temperature is lowered, the concentration of solid material increases developing a gel caused by the formation of a coherent three dimensional network of wax crystals. As a result of this crystal structure, large amounts of oil are entrained in the crystal lattice of wax, thereby preventing the flow of the oil.

The lowest temperature at which the oil will still flow is generally known as the pour point. In the case of fuels, when the oil temperature goes below the pour point and the fuel is no longer freely flowable, difficulty arises in transporting the fuel through flow lines and pumps, as for example, when attempting to transfer the fuel from one storage vessel to another by gravity, or under pump pressure, or when attempting to feed the fuel into a burner. Additionally, the wax crystals that come out of solution tend to plug fuel lines, screens and filters.

This problem has been well recognized in the past and various additives have been suggested for depressing the pour point of oil. One function of such pour point depressants has been to change the nature of the crystals that precipitate from the oil, thereby reducing the tendency of the wax crystals to interlock and set into a gel.

Recently, various oil-soluble polymers characterized by long linear side chains have become known as flow improvers for oils containing high boiling waxes, e.g., waxy crude oils, residua-containing fuel oils, and flash distillate oils. One group of such polymers described in British Pat. No. 1,215,214 and U.S. Pat. No. 3,447,916 is prepared by condensation reactions of a dicarboxylic acid or anhydride, with a basic material which can be a polyol, polyamine or amino alcohol, together with a monocarboxylic acid. A further improvement of this type of flow improver condensation polymer is described in British Pat. No. 1,215,214, wherein pentaerythritol is the polyol. Similarly, addition polymers having long linear side chains have been described in British Pat. Nos. 1,154,966, 1,161,188 and 1,197,474 as flow improvers for crude and residua-containing fuel oils. The most important of these addition polymers are prepared by polymerizing long chain unsaturated esters, such as copolymers of vinyl acetate and behenyl fumarate, or homopolymers of behenyl acrylate, etc. Another class of addition polymers useful in residua and heavy fuel oils, are those described in South African Pat. No. 70/6785, and published German Application No. 1,940,944. Here, long chain alpha olefins are copolymerized with maleic anhydride, which copolymer is then further reacted with long straight chain alcohols or amines. Still another class are polymers and copolymers of straight chain $C_{18}$ to $C_{40}$ alpha monoolefins, for example, see British Pat. No. 1,267,604 which shows their use in crude oil and French published patent application No. 6,931,526 which shows their use in residuum.

It is also known that some asphaltene fractions can modify the crystal habit of wax separating from wax solvent systems and, in some cases, lower the pour points of such systems. See, for example, B. F. Birdwell, Thesis, University of Texas, 1964, entitled "Effects of Various Additives on Crystal Habit and Other Properties of Petroleum Wax Solutions." This document is available from University Microfilms, Ann Arbor, Michigan.

SUMMARY OF THE INVENTION

It has now been found that the response of certain heavy fuel oils to the aforesaid types of long side chain polymeric flow improver, can be frequently improved by incorporating into the fuel oil a minor amount of asphaltene e.g. between about 0.05 and 10, preferably 0.1 to 6% by weight, based on the weight of the final fuel.

The present invention is not applicable to all high boiling fuel oils and generally each oil must be individually tested to determine if the addition of asphaltene brings about an improved response to the flow improvers. Thus, the present invention is directed to heavy fuels comprising residuum, or vacuum oils, susceptible to flow improvement as a result of having a flow improver and asphaltene added thereto.

Accordingly, in one aspect of the present invention, a method is provided for determining the susceptibility of a heavy fuel oil to improvements in low temperature flow properties which comprises adding a polymeric flow improver to the oil, and then adding an asphaltene material to determine if the low temperature properties of the oil have been further improved. Generally, as the asphaltene content of a heavy fuel originally containing almost no asphaltenes, or a low asphaltene content, is increased, the response of the fuel to a given quantity of flow improver increases until some optimum asphaltene level is reached. A further increase in asphaltene content then reduces the response of the fuel to the polymeric flow improver. Each fuel type has its own optimum level of asphaltene content to obtain maximum response.

The present invention also provides novel additives for improving the low temperature properties of residuum fuel oils and flash distillate oils which comprise (a) a polymer flow improver, (b) an asphaltene and (c) a hydrocarbon solvent, or can comprise a polymeric flow improver in admixture with an asphaltene.

DETAILED DESCRIPTION OF THE PRESENT INVENTION

The Fuel Oil

The fuel oils, to which the present invention is applicable, are residua-containing oils such as straight residuum, vacuum distillate fuels such as flash distillate oils, vacuum bottoms, and various blends of such residua-containing oils with middle distillate, e.g., 300°–650° F oils, particularly heavy gas oils, e.g., 500°–650° F oils. Residua containing oils are oils that contain residua from the atmospheric distillation of crude oil or shale oil or mixtures thereof. They can also be residues obtained by thermal cracking or catalytic cracking processes. Generally, the residua, or residuum-containing fuel will contain about 10 to 100%, e.g., about 20 to 100% by weight of residuum, and will preferably have an initial boiling point above 600° F, most preferably above 650° F, at atmospheric pressure. If 100% residuum, the oil is generally designated as No. 6 fuel oil, Bunker C fuel oil, etc. Residual products usually have an extremely high viscosity and conventionally are blended with distillate oils to form residuum containfuels. The distillate oil can be a middle distillate fuel oil or a vacuum or flash-distillate oil.

Vacuum fuel oils are frequently made by flash distillation and are then called flash distillates. Flash-distillates are therefore those distillate fuels obtained by flash distillation at reduced pressure of the residue obtained from the distillation of crude oil at atmospheric pressure. Such fuels are generally prepared by first distilling, under atmospheric pressure, a crude oil to a bottom temperature of approximately 600°-650° F, usually 650° F+, thereby obtaining an atmospheric residuum. This residuum is then divided by "flashing" under greatly reduced pressure into a "flashed" distillate and a vacuum residue. As a result of the distillation technique used, the vacuum or flash distillates contain high boiling waxes found also in the residua. Owing to the presence of these higher waxes, which generally are not found in the usual middle distillate fuel such as gas oil, the flashed distillates show a close relationship to the residual fuels, in particular as regards their characteristics at low temperature. Flash distillates will usually boil at atmospheric pressure in the range of about 650°-1100° F and may be used per se as fuel, or may be blended with residuum as noted above, or with middle distillate fuels, e.g., heavy gas oils boiling in the 500°-650° F range. The term vacuum or flash distillate as used herein will mean a fuel containing 20 to 100% of vacuum or flash distillate boiling above 600° F, preferably above 650° F at atmospheric pressure.

Some residua oils have extremely high pour points, particularly those obtained from North African crudes, e.g., those from Libya, due to a high wax content. These oils also have low sulfur contents which make them particularly desirable because of air pollution requirements in spite of the handling difficulties due to their high wax content. Some detailed characteristics of these oils are given in Tables I and II of British Pat. No. 1,197,474.

In accordance with the present invention, the response of a residua-containing fuel oil or vacuum fuel oil, is improved by incorporating into the fuel oil a minor amount, for example, 0.05 to 10 weight percent, preferably 0.1 to 6 weight percent, and usually about 0.1 to 4 weight percent, of asphaltene. In general, about 0.05 to 1 weight percent of added asphaltene appears effective in vacuum oils, while 0.5 to 10 weight percent asphaltene appears useful in straight atmospheric residuum oil.

The Asphaltene Material

Asphaltenes are known to the art as the highly aromatic, high molecular weight constituents contained in many crude petroleum residua and natural asphalts, particularly those known as asphalt-bearing residua. Typical properties of these materials are known to the art, e.g., U.S. Pat. No. 3,093,573. Asphaltenes are generally solid, insoluble in alkanes, and can be isolated by contacting an asphalt-bearing residuum with a solvent-precipitant, normally a liquid paraffin having 5 to 9 carbon atoms, preferably n-heptane, in a ratio by volume of generally at least 4 parts of solvent-precipitant per part of residuum. The precipitant causes the asphaltene fraction to precipitate out as a solid material which can be subsequently removed by filtration, centrifugation, etc. A detailed description of one method of recovering asphaltenes is given in U.S. Pat. No. 3,087,887. Asphaltenes prepared in this manner are usually characterized by the substantial lack of any petrolene, e.g., aliphatic hydrocarbon soluble, component.

Asphaltenes suitable for use in this invention will usually have softening points, according to ASTM D-36-70, above about 350° F, preferably above about 450° F, or capillary tube melting points above about 300° F, preferably above about 400° F.

It is also possible to utilize asphaltene-containing refinery streams in the present invention. Such refinery streams may be asphalts, tars and certain residual oils themselves, such as Amuay heavy fuel oil, certain residuum vacuum bottoms, i.e., the portion boiling above about 1100° F, Tiajuana medium residua, Venezuelan residua, etc., such as LM Tar, etc. Such asphaltene-containing refinery streams will frequently contain from 5 to 25 weight percent asphaltenes based on the total weight of the stream and can be blended directly with the fuel oil to give the desired asphaltene content to the fuel.

Polymer Flow Improver Additives

As discussed above, a large number of oil soluble polymeric flow improvers for heavy fuels with long linear chains are now known to the art, and can be used in the present invention. In general, these flow improver polymers will have number average molecular weights, as measured for example by Vapor Pressure Osmometry, e.g., using a Mechrolab Vapor Pressure Osmometer Model 310A, etc., in the range of about 1000 to 100,000 and usually in the range of about 2000 to 40,000. These polymers will usually have at least 50 weight percent of the polymer in the form of long straight chain alkyl groups, usually of about 18 to about 44, e.g., 20 to 40 carbon atoms. Some of the more important classes of these heavy fuel flow improvers useful in the invention are described in detail below.

Long Side Chain Condensation Polymers

These are condensation polymers of one or more alkyl or alkenyl substituted dicarboxylic acids or anhydrides in which the alkyl or alkenyl group includes a linear portion of 18 to 44 preferably 20 to 40 carbon atoms, with a polybasic material, e.g., a polyol, and a monocarboxylic acid.

The substituted dicarboxylic acids, or their anhydrides can be represented by the general formulae:

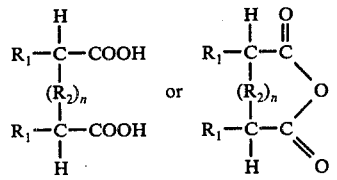

wherein $n$ is a number from 0 to 1 and each $R_1$ can be hydrogen or a hydrocarbon group such as an alkenyl group or alkyl group of 1 to 40 carbon atoms, and at least one of said $R_1$ in each formula is a $C_{18}$ to $C_{44}$ alkenyl group. Preferably $R_2$ is a divalent saturated aliphatic carbon group of 2 to 6 carbon atoms. The acid or anhydride can be readily made by the reaction of a $C_{18}$ to $C_{42}$ olefin with maleic anhydride to form an alkenyl or alkyl succinic anhydride which can then be easily hydrolyzed to the corresponding acid.

The polyol includes polyhydric aliphatic alcohols having 2 to 6, e.g., 3–4 hydroxy groups and a total of 2 to 12 e.g., 4 to 12, carbon atoms. Examples of such alcohols include ethylene glycol, glycerol, sorbitol, pentaerythritol, polyethylene glycols, diethanol amine, dipentaerythritol, triethanolamine, N,N'-di(hydroxyethyl)-ethylene diamine and the like. If the alcohol reactant contains reactive amino hydrogens (or if an amine reactant contains reactive hydroxyl groups), a mixture comprising the reaction products of, for example, the substituted succinic acid reactant and both the hydroxyl and amino functional groups is possible. Such reaction products can include half-esters, half-amides, esters, amides and imides.

The monocarboxylic acids used to make long chain condensation polymers are of the formula $R_5COOH$ wherein $R_5$ is an alkyl group, preferably containing from 6 to 44, usually 18 to 44 carbon atoms, e.g., octadecyl. The group $R_5$ is also preferably straight-chained. However, acids where $R_5$ is an alkenyl, alkaryl, aryl or aralkyl group may be used. Examples of suitable acids are dodecanoic acid, heptadecanoic acid, eicosanoic acid, tetracosanoic acid, triacontanoic acid, benzoic acid and phenyl acetic acid. Alternatively, mixtures of monocarboxylic acids may be used, e.g., a mixture of $C_{12}$ and $C_{14}$ acids.

In order to prepare the polymer, the three components are reacted with one another, preferably in equimolar quantities, but small variations from equimolar quantities can readily be used, e.g., 0.8 to 1.6 moles of dicarboxylic acid reacted with 0.8 to 1.2 moles of polyol and 0.8 to 1.2 moles of monocarboxylic acid. Processes for preparing these polymers are described in detail in U.S. Pat. No. 3,447,916 and essentially simply involve heating the monomers together, preferably in the presence of the hydrocarbon solvent, and removing water until the desired molecular weight is achieved. Usually, to minimize gelling due to cross-linking, the polyol and monocarboxylic acid can be premixed and then added to the dicarboxylic acid component.

Addition Polymers of Unsaturated Ester

The addition polymers used in the invention include polymers of long side chain unsaturated esters. Generally, at least 25 mole %, and preferably 50 to 100 mole %, of the polymer ester monomer is characterized by $C_{18+}$ linear side chains. These esters include unsaturated mono- and diesters and can be represented by the formula:

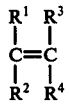

wherein $R^1$ is hydrogen or $C_1$ to $C_5$ alkyl groups; $R^2$ is a —$OOCR^5$ or —$COOR^5$ group wherein $R^5$ is hydrogen or a $C_{18}$ to $C_{44}$, preferably a $C_{20}$ to $C_{30}$, alkyl group and $R^3$ and $R^4$ are either hydrogen or —$COOR^5$. Such monomers, when $R^1$ is hydrogen and $R^2$ is —$OOCR^5$, include vinyl alcohol esters of monocarboxylic acids. Examples of such esters include vinyl stearate, vinyl behenate, vinyl tricosanate, etc. When $R^2$ is —COOR, such esters include behenyl acrylate, behenyl methacrylate, triconsanyl acrylate, triconsinyl methacrylate, etc. Examples of monomers where $R^1$ is hydrogen, and $R^2$ and $R^4$ are both —$COOR^5$ groups, include: esters of unsaturated dicarboxylic acids such as eicosyl fumarate, docosyl fumarate, eicosyl maleate, docosyl citraconate, docosyl maleate, eicosyl mesaconate, eicosyl citraconate, docosyl itaconate, tricosyl fumarate, tetracosyl maleate, pentacosyl citraconate, hexacosyl mesaconate, octacosyl fumarate, noncosyl maleate, triacontyl citraconate, hentriacontyl mesaconate, triacontyl fumarate, etc.

The long chain aliphatic esters described above may be prepared from aliphatic alcohols containing from 18 to 44 carbon atoms per molecule. Saturated aliphatic alcohols containing from 20 to 30 carbon atoms per molecule are particularly preferred. Mixed esters derived by the reaction of the acids with a mixture of alcohols may be used, and one may also use a mixture of alcohols wherein a minor amount of the alcohol contains shorter chain alcohols, e.g., 1 to 17 carbon atoms per molecule. Examples of alcohols suitable for use in producing the esters include straight chain normal primary alcohols such as stearyl, nonadecyl, eicosyl, docosyl, tricosyl, tetracosyl, pentacosyl, hexacosyl, heptacosyl, octacosyl noncosyl, and triacontyl alcohols, etc.

Commercially marketed mixtures of alcohols consisting essentially of saturated alcohols of the requisite chain length may be employed in preparing the long chain esters. One such mixture is marketed under the name behenyl alcohol and is a mixture of alcohols derived from natural sources and consists primarily of docosyl alcohol but contains minor amounts of other alcohols containing from 16 to 24 carbon atoms per molecule.

The carboxylic acid esters of this invention may also be prepared from straight chain as well as branched chain alcohols having a chain length, excluding branching, of from 18 to 44 carbon atoms per molecule.

Short chain unsaturated esters, having the above-noted formula but wherein $R^4$ has less than 18 carbons, preferably 1 to 5 carbons in amounts of 30 to 70 molar % based on the total polymer, can be copolymerized with the long chain unsaturated esters. For example, monomers such as vinyl acetate can be copolymerized with dibehenyl fumarate.

The ethylenically unsaturated monomers described in the preceding paragraphs are polymerized in a conventional manner to produce the polymers useful in the present invention. For example, the polymerization reaction may be carried out without diluent or in a solution of a hydrocarbon solvent such as heptane, benzene, cyclohexane or white oil, at a temperature in the range of from 60° to 250° F and may be promoted by a peroxide type catalyst such as benzoyl peroxide, a hydroperoxide or an azo catalyst such as alpha - alpha' - azo - bis - isobutyronitrile. It is generally preferred to carry out the polymerization reaction under a blanket of an inert gas such as nitrogen or carbon dioxide in order to exclude oxygen. The polymerization time may vary from 1 to 36 hours.

Addition Copolymers of Unsaturated Esters and Olefins

Another class of useful addition polymers are those of an unsaturated ester and an alpha-olefin. These can be prepared by direct copolymerization of the olefin and ester. However, it is usually easier to polymerize the olefin with unsaturated acid, preferably a dicarboxylic acid, and then esterify with alcohol or amines.

Suitable ethylenically unsaturated dicarboxylic acids have 4 to 10 carbons and include maleic acid, fumaric acid, mesaconic acid, citraconic acid, itaconic acid, trans and cis-glutaconic acids. The corresponding anhydrides (where they exist) can also be used. Preferred is maleic anhydride.

The ethylenically unsaturated dicarboxylic acid, or anhydride or derivative thereof, is reacted with an olefin containing 18 or more carbon atoms per molecule. Although there is no upper limit to the number of carbon atoms per molecule, in practice olefins containing between 18 and 46, e.g., between 20 and 32, carbon atoms per molecule will generally be used. Mixtures of olefins may be used, e.g., a $C_{22}$–$C_{28}$ mixture. Suitable olefins include 1-alkenes, 2-alkenes and the like, including the $C_{20}$–$C_{46}$ alpha monolefins described in detail in "Olefin Polymers" below.

The reaction between the dicarboxylic acid, anhydride or derivative and olefin can conveniently be carried out by mixing the olefin and anhydride or derivative, usually in about equimolar amounts, and heating the mixture to a temperature of at least 180° F, preferably at least 250° F. A free radical polymerization promoter such as t-butyl hydroperoxide or di-t-butyl peroxide is normally used.

The addition product thus prepared is reacted with an alcohol or with an amine containing 18 to 44 carbon atoms per molecule. The alcohol may be a linear or branched but the preferred ones are aliphatic, substantially linear monohydric alcohols. Such alcohols include eicosanol, $C_{22}$ Oxo alcohol, tetracosanol, and may include mixtures of such alcohols, for example, behenyl alcohol. The amine can be acyclic or a primary or secondary monoamine containing at least 18 to 26 carbon atoms per molecule. Examples of such amines are 1-docosylamine; 2-tetracosylamine; 1-octadecylmethyl amine or 1-docosyl ethyl amine.

Olefin Polymers

Olefin polymers which can be either homopolymers of long chain alpha monoolefins, or copolymers of said long chain monoolefins with short chain olefins, are also useful in the invention. Thus, these polymers will generally comprise 20 to 100 weight percent $C_{20}$ to $C_{46}$ alpha-olefin and 0 to 80 weight percent $C_3$ to $C_{18}$ monoolefin. Of these, copolymers containing 50 to 96 weight percent of linear $C_{22}$ to $C_{46}$ alpha monoolefin and 4 to 50 weight percent of $C_3$ to $C_{18}$ monoolefin are particularly effective. An especially preferred polymer comprises 60–80 weight percent of a $C_{22-30}$ alpha-olefin and 20 to 40 weight percent of a $C_4$–$C_6$ alpha-olefin.

The $C_{20}$–$C_{46}$ alpha-olefin monomer which is used to prepare the polymer may be represented by the following general formula: $H_2C{=}CHR$ wherein R is a substantially linear aliphatic hydrocarbon radical containing from 18 to 44 carbon atoms. The term "substantially linear" denotes those aliphatic side chains, e.g., R above which contain no more than one lower alkyl side chain such as methyl, ethyl, etc., in the radical and wherein said lower alkyl side chain, when present in the radical is located at a position such that R has a linear portion containing at least 18 carbon atoms. Examples of such monomers include, among others, n-eicosene-1, 3-methyl docosene-1, n-docosene-1, n-tetracosene-1, 3-methyl tetracosene-1, n-hexacosene-1, n-triacontene-1 and the like.

The $C_3$–$C_{18}$ alpha-olefins may be represented by the following general formula $H_2C{=}CHR'$, wherein R' is a hydrocarbon radical containing from 1 to 16 carbon atoms. Since the lower alpha-olefin apparently serves only to disrupt the degree of order of the polymer, there appears to be no criticality as to the configuration of R'. Accordingly, R' may be an alkyl, aralkyl, aryl, alkyaryl or cycloaliphatic group. Examples of such monomers include propylene, butene-1, hexene-1, octene-1, decene-1, 3-methyl decene-1, tetradecene-1, styrene and styrene derivatives such as p-methyl styrene, p-isopropyl styrene, alphamethyl styrene, etc.

These olefin polymers may be conventionally prepared by polymerizing the monomers under relatively mild conditions of temperature and pressure in the presence of a Ziegler-type catalyst, i.e., a mixture of a compound derived from a Group IV, V or VI metal of the Periodic Table in combination with an organo metallic compound of a Group I, II, or III metal of the Periodic Table wherein the amount of the compound derived from a Group IV–VI metal may range from 0.01 to 2.0 moles per mole of the organo metallic compound.

Effective catalysts for polymerizing the monomers of the invention include the following combinations: aluminum triisobutyl and vanadium trichloride; aluminum triisobutyl, aluminum chloride, and vanadium trichloride; vanadium tetrachloride and aluminum trihexyl; vanadium trichloride and aluminum trihexyl; vanadium triacetylacetonate and aluminum diethyl chloride; titanium tetrachloride and aluminum trihexyl; vanadium trichloride and aluminum trihexyl; titanium trichloride and aluminum trixhexyl; titanium dichloride and aluminum trihexyl, etc.

The polymerization is usually carried out by mixing the catalyst components in an inert diluent such as a hydrocarbon solvent, e.g., hexane, benzene, toluene, xylene, heptane, etc., and then adding the monomers into the catalyst mixture at atmospheric or superatmospheric pressures and temperatures within the range between about 50° and 180° F. Usually atmospheric pressure is employed when polymerizing the monomers containing more than 4 carbon atoms in the molecule and elevated pressures are used for the more volatile $C_3$–$C_4$ alpha-olefins. The time of reaction will depend upon, and is interrelated to, the temperature of the reaction, the choice of catalyst, and the pressure employed. In general, however, ½ to 5 hours will complete the reaction.

Usually, based upon 100 parts by weight of polymer to be produced, about 120 to 100,000 parts by weight of solvent, and about 0.05 to 5 parts by weight of catalyst will be used in the polymerization.

The Final Fuel Composition

The preparation of the fuel oil compositions of the present invention involves no special technique. Generally, the compositions are formed by adding appropriate amounts of polymeric flow improver and asphaltene containing material to the fuel oil while hot, e.g., about 200° F or hotter, and stirring or agitating the composition until the flow improver and asphaltene are dissolved.

The pour point depressant or flow improver is generally used in a concentration in the range of from about 0.001 to about 2 weight percent, preferably from about 0.005 to about 0.5 percent by weight, based on the weight of the fuel oil being treated.

The asphaltene can be added to the residua containing fuel or flash distillate separately from the flow improver, or can be added as a mixture with the flow improver, say 0.5 to 100 parts by weight of asphaltene per part by weight of flow improver polymers. The mixture of asphaltene and polymeric flow improver can also be prepared as a concentrate in a hydrocarbon solvent where the concentrate comprises 0 to 90 weight percent of solvent and 10 to 100 weight percent of said mixture. Typical hydrocarbon solvents include, among others, mineral oils, hexane, heptane and the like.

It will be understood that although the fuel oil blends tested in the following examples contain only pour depressant additives, other additives that are useful in residuum containing fuels and flash distillates can also be employed.

The following examples are given by way of illustration to further explain the principles of the invention. These examples are merely illustrative and are not to be understood as limiting the scope and underlying the principles of the invention in any way. All percentages referred to herein are by weight unless otherwise specifically indicated.

EXAMPLE 1

In this example, an oil concentrate of a polymeric flow improver (hereinafter called Flow Improver A) was used. Flow Improver A consisted of about 50 weight percent of a mineral distillate oil and about 50 weight percent of a copolymer of behenyl fumarate and vinyl acetate in about equal molar proportions, said copolymer having a number average molecular weight by Vapor Pressure Osmometry of about 6000. The behenyl fumarate was made by esterifying fumaric acid with a commercial behenyl alcohol which was about 65 weight percent $C_{22}$ alcohol, about 15 weight percent of $C_{20}$ alcohol and about 15 weight percent of $C_{18}$ alcohol, all of said alcohols being straight chain alcohols.

A base oil blend (Blend 1) of two fuels, Fuels A and B, is prepared and tested for Flow Point and asphaltene content. Fuel A is a vacuum gas oil (flash distillate) boiling in the range of 650°–1100° F (atmospheric equivalent vapor temperature) obtained by distillation of Brega crude oils, which is a crude from North Africa. Fuel B is a heavy middle distillate gas oil boiling in the range of about 520° to 650° F.

The blend is tested for pour point according to the ASTM D-97-66 procedure except that the blend under test is first divided into 4 samples and each sample is then heated to 200° F and quickly cooled to 0° F to wipe out any prior thermal history of the oil. The oil samples are then heated to various reheat temperatures of 100°, 115°, 130° and 150° F respectively where they are maintained at the reheat temperature for ½ hour. The oil samples are then tested for pour point following the ASTM D-97-66 procedure and the pour point at each of the 4 reheat temperatures is reported. The Flow Point of the blend is defined as the highest pour point obtained at any of the 4 reheat temperatures under consideration. The Flow Point is the highest pour point that the oil would be expected to exhibit regardless of what prior thermal history the oil might encounter. In other words, this test gives the oil four different thermal histories (which are representative of the temperatures that the oil may encounter after it is cooled from the initial refining operation) and then determines the pour point for each of these histories.

Briefly described, the asphaltene content of the blend is determined by mixing a 1 gram sample of it with 5 ml. of carbon disulfide to dissolve it, and then adding 100 ml. of a light paraffinic naphtha (86°), heating the mixture to 100° F for at least 2 hours and then filtering it through an asbestos pad, with suction. The sediment remaining on the pad and in the sample flask, after washing and drying, is weighed. Duplicate runs are made, and the sediments (the asphaltenes), calculated as weight percent of the original samples, are averaged. Results are reported to the nearest 0.1 weight percent and Blend 1 shows an asphaltene content of 0.1 weight percent.

Five additional blends (Blends 2–6) are prepared from fuels A and B containing various amounts of Flow Improver A and/or asphaltenes. The asphaltenes are obtained by heptane precipitation from crude oil from the Lagunilas field. Blend 2 contains 0.1 weight percent of Flow Improver A; Blend 3 contains 0.2 weight percent of Flow Improver A; Blend 4 contains 0.2 weight percent of asphaltene; Blend 5 contains 2.0 weight percent of asphaltene; and Blend 6 contains 10 weight percent of asphaltene. Blends 7 to 9 are prepared in accordance with the present invention and contain both Flow Improver A and asphaltene.

Each of the blends is tested for Flow Point in accordance with the procedure set forth above. The compositions of the blends and their Flow Points are given in Table 1 below.

TABLE I

| Components | Blend 1 | Blend 2 | Blend 3 | Blend 4 | Blend 5 | Blend 6 | Blend 7 | Blend 8 | Blend 9 |
|---|---|---|---|---|---|---|---|---|---|
| Fuel A, wt.% | 62.5 | 62.4 | 62.3 | 62.3 | 60.5 | 55.5 | 62.25 | 62.2 | 62.1 |
| Fuel B, wt.% | 37.5 | 37.5 | 37.5 | 37.5 | 37.5 | 34.5 | 37.5 | 37.5 | 37.5 |
| Flow Improver A, wt.% | — | 0.1 | 0.2 | — | — | — | 0.05 | 0.1 | 0.2 |
| Asphaltenes, wt.% | — | — | — | 0.2 | 2.0 | 10.0 | 0.2 | 0.2 | 0.2 |
| Flow Points, ° F. | 90 | 70 | 70 | 90 | 90 | 90 | 60 | 50 | 50 |
| | Pour Point, ° F., at Reheat Temperature | | | | | | | | |
| Reheat Temperature, ° F. | | | | | | | | | |
| 150 | 90 | 70 | 60 | 90 | 90 | 90 | 60 | 50 | 50 |
| 130 | 90 | 70 | 60 | 90 | 90 | 90 | 60 | 50 | 50 |
| 115 | 90 | 70 | 60 | 90 | 90 | 90 | 55 | 50 | 50 |
| 100 | 90 | 65 | 70 | 90 | 90 | 90 | 50 | 50 | 50 |

From an examination of the data in Table 1, it can be seen that the combination of polymeric form improver and asphaltenes in Blends 7 to 9 prepared in accordance with the present invention lowers the Flow Points of the base oil (Blend 1) by 30° to 40° F.

Asphaltenes alone, in the range of 0.2 to 10 weight percent, have no effect on Flow Point as evidenced by Blends 4 to 6, while the polymeric flow improver alone (Blends 2 and 3) has some effect but not as much as when it is combined with the asphaltenes. Clearly, the addition of asphaltenes to the oil has improved its response to the polymeric flow improver.

EXAMPLE II

Fuel blends were made of low asphaltene, waxy straight atmospheric residua boiling at 650° F+ (Fuels C and D) obtained by the atmospheric distillation of crude, with Fuel E, which was a 650° F+ atmospheric residua, low in wax but high in asphaltene. Fuel C was from Bass Strait crude, Fuel D was from crude from the Amna field in Libya, and Fuel E is known as LM tar and is a Venzuelan atmospheric bottoms or residuum. For comparison, Fuels C and D were also blended with Fuel B, which was a heavy gas oil previously described. The pour points of those oils are summarized in Table II which follows:

TABLE II

| Fuel | Properties of Fuels C | D | E | B |
|---|---|---|---|---|
| Pour Point at Reheat Temperature of: | | | | |
| 150° F | 100+ | 100 | 45 | 25 |
| 130° F | 100+ | 95 | 50 | 35 |
| 115° F | 100+ | 95 | 50 | 30 |
| 110° F | 100+ | 90 | 50 | 25 |
| Flow Point, ° F | 100+ | 100 | 50 | 35 |

Blends 10 to 17 were made up by simple mixing of various combinations of Fuels C, D, E and B, with and without Flow Improver A. The pour points of these blends, their Flow Point (i.e., the highest pour point at any of the four reheat temperatures) and asphaltene content are summarized in Table III which follows.

TABLE III

| Fuels, Wt.% | Blend 10 | Blend 11 | Blend 12 | Blend 13 | Blend 14 | Blend 15 | Blend 16 | Blend 17 |
|---|---|---|---|---|---|---|---|---|
| C | — | — | — | — | 20 | 20 | 20 | 20 |
| D | 70 | 69.9 | 70 | 69.9 | — | — | 80 | 79.9 |
| E | — | — | 30 | 30 | — | — | — | — |
| B | 30 | 30 | — | — | 80 | 79.9 | — | — |
| Flow Improver A, wt.% | — | 0.1 | — | 0.1 | — | 0.1 | — | 0.1 |
| Asphaltenes, wt.% | 3.1 | 3.1 | 6.9 | 6.9 | 0.6 | 0.6 | 10.7 | 10.7 |
| Flow Point, ° F. | 75 | 70 | 85 | 60 | 65 | 65 | 85 | 55 |
| | Pour Point, ° F., at Reheat Temperatures | | | | | | | |
| Reheat Temperature, ° F. | | | | | | | | |
| 150 | 70 | 70 | 80 | 40 | 65 | 60 | 85 | 55 |
| 130 | 70 | 50 | 85 | 50 | 65 | 65 | 85 | 45 |
| 115 | 75 | 55 | 85 | 50 | 65 | 60 | 85 | 45 |
| 110 | 75 | 65 | 85 | 60 | 65 | 60 | 85 | 45 |

Considering now Table III, Blend 10 had a Flow Point of 75° F. Adding Flow Improver A (Blend 11) decreased the Flow Point to 70° F, while substituting residuum Fuel E for the gas oil, so as to raise the asphaltene content (Blend 12), increased the Flow Point to 85° F. However, when the asphaltene level was raised and the Flow Improver A was also used (Blend 13) a Flow Point of 60° F was obtained. Similar results were obtained in Blends 14 to 17, i.e., Blend 14 had a low asphaltene content, and did not respond too well to the Flow Improver (Blend 15) or to raising the asphaltene content (Blend 16) but when both Flow Improver and a higher asphaltene level were both used, a low Flow Point of 55° F was obtained (Blend 17).

Thus, Example I shows the invention applied to a vacuum gas oil using asphaltenes per se, while Example II shows the invention applied to straight atmospheric residuum wherein the asphaltenes are added by blending with another residua high in asphaltenes.

The invention in its broader aspects is not limited to the specific details shown and described and departures may be made from such details without departing from the principles of the invention and without sacrificing its chief advantages.

What is claimed is:

1. A petroleum fuel oil composition comprising a heavy waxy fuel oil selected from the group consisting of atmospheric residua, vacuum gas oil, vacuum bottoms, blends of said oils, and blends of said oils with middle distillate fuels, which are deficient in an asphaltene component wherein at least 20 weight percent of said composition boils above 600° F., containing a pour point improving amount of an oil-soluble polymeric flow improver consisting of a copolymer of behenyl fumarate and vinyl acetate in about equal molar proportions, the behenyl fumarate having been prepared by esterifying fumaric acid with a behenyl alcohol containing about 65 wt. % $C_{22}$ alcohol, about 15 wt. % $C_{20}$ alcohol and about 15 wt. % $C_{18}$ alcohol, all of said alcohols being straight chain alcohols, said copolymer having a number average molecular weight within the range from about 1000 to 100,000, which oil composition has been improved with respect to its responsiveness to said flow improver by adding an amount of asphaltene sufficient to increase the asphaltene content of said oil by 0.05 to 10 weight percent.

2. An oil composition according to claim 1, wherein said asphaltene is added as an asphaltene per se.

3. An oil composition according to claim 1, wherein sufficient asphaltene is added to impart 0.1 to 6.0 weight percent asphaltene to said composition and said asphaltene containing material is added as a petroleum fraction containing in the range of about 5 to 25 weight percent asphaltene.

4. An oil composition according to claim 1, wherein said heavy waxy fuel oil is an atmospheric residua.

5. An oil composition according to claim 1, wherein said heavy waxy fuel oil is a vacuum gas oil.

6. A flow improver composition useful for improving flow of fuel oils comprising residua and flashed distillates which comprises a mixture of polymeric flow improver for such oils consisting of a copolymer of behenyl fumarate and vinyl acetate in about equal molar proportions, the behenyl fumarate having been prepared by esterifying fumaric acid with a behenyl alcohol containing about 65 wt. % $C_{22}$ alcohol, about 15 wt. % $C_{20}$ alcohol and about 15 wt. % $C_{18}$ alcohol, all of said alcohols being straight chain alcohols, said copolymer having a number average molecular weight within the range from about 1000 to about 10,000 and asphaltene.

7. A composition according to claim 6, which is a comcentrate of 0 to 90 percent of a hydrocarbon solvent and 10 to 100 weight percent of a mixture of 0.5 to 100 parts by weight of asphaltene per part by weight of said polymeric flow improver.

* * * * *